US008137242B2

(12) United States Patent
VanElverdinghe et al.

(10) Patent No.: US 8,137,242 B2
(45) **Date of Patent: *Mar. 20, 2012**

(54) RECREATIONAL STRUCTURE USING A COUPLING MEMBER

(75) Inventors: Jeffry L. VanElverdinghe, Beaverton, OR (US); Craig Adams, Portland, OR (US)

(73) Assignee: CA06, LLC, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/379,772

(22) Filed: Apr. 21, 2006

(65) Prior Publication Data

US 2006/0189441 A1 Aug. 24, 2006

Related U.S. Application Data

(63) Continuation-in-part of application No. 10/908,469, filed on May 12, 2005, now Pat. No. 7,494,444, which is a continuation-in-part of application No. 10/905,105, filed on Dec. 15, 2004.

(60) Provisional application No. 60/530,054, filed on Dec. 16, 2003.

(51) Int. Cl.
*A63B 5/11* (2006.01)

(52) U.S. Cl. ..... 482/27

(58) Field of Classification Search ..... 482/27–29
See application file for complete search history.

(56) References Cited

U.S. PATENT DOCUMENTS

| | | | | |
|---|---|---|---|---|
| 774,393 | A | | 11/1904 | Palmer |
| 959,973 | A | | 5/1910 | Tomkins |
| 1,488,244 | A | | 10/1920 | Hinton |
| 1,830,262 | A | | 11/1931 | Carlson |
| 1,850,049 | A | | 3/1932 | Cornell, Jr. |
| 1,982,498 | A | | 11/1934 | Cornell, Jr. |
| 1,992,312 | A | | 2/1935 | Kuehn |
| 2,128,720 | A | | 8/1938 | Tweedate |
| 2,430,714 | A | * | 11/1947 | Geer ..... 182/139 |
| 2,858,551 | A | | 11/1953 | Sidlinger |
| 2,809,383 | A | | 10/1957 | Fenner et al. |
| 2,931,129 | A | | 4/1960 | Bonlface |
| 3,201,126 | A | | 8/1965 | Nissen |
| 3,339,925 | A | | 9/1967 | Nissen |
| 3,502,357 | A | | 3/1970 | Wagner |
| 3,837,643 | A | | 9/1974 | Lee |

(Continued)

FOREIGN PATENT DOCUMENTS

AU 2004100729 A4 9/2004

OTHER PUBLICATIONS

H176, Johnstone, Jr., "Slip Tee Pipe Fitting," Dec. 2, 1986.

(Continued)

*Primary Examiner* — Fenn Mathew

(74) *Attorney, Agent, or Firm* — Harness, Dickey & Pierce, LLP

(57) ABSTRACT

A recreational structure, such as a trampoline frame, can be quickly and reliably assembled using a coupling member generally having a "T" configuration. A first arm member and a second arm member are disposed in an opposite relationship with each other. The first and second arm members each receive one end of a horizontal frame member of the recreational structure. The third arm member includes flange members that receive one end of a vertical frame member of the recreational structure and one end of a vertical pole member of, for example, a safety enclosure.

10 Claims, 12 Drawing Sheets

U.S. PATENT DOCUMENTS 3,988,872 A 11/1976 Adamson et al.
4,008,971 A 2/1977 Wah et al.
4,139,192 A 2/1979 McNeil
4,157,801 A 6/1979 Elmer
RE30,344 E 7/1980 McNeil
4,284,271 A 8/1981 Pettit et al.
4,339,123 A 7/1982 Rich
4,359,851 A 11/1982 Daniels
4,370,790 A 2/1983 Rodaway
4,386,772 A * 6/1983 Wu ..... 482/28
4,413,361 A 11/1983 Wolf et al.
4,433,838 A 2/1984 Gordon
4,478,420 A 10/1984 Sowards
4,480,941 A 11/1984 Gilb et al.
4,514,107 A 4/1985 Moreno
4,540,309 A 9/1985 Hansson
4,569,515 A 2/1986 Gordon
4,572,695 A 2/1986 Gilb
4,598,905 A 7/1986 Vrana
4,644,892 A 2/1987 Fisher
4,703,769 A 11/1987 Harrison, Jr.
4,776,581 A 10/1988 Shepardson
4,836,530 A 6/1989 Stanley, Jr.
4,863,156 A 9/1989 Shaw
4,885,883 A 12/1989 Wright
4,900,011 A 2/1990 Nolet
5,010,603 A 4/1991 Hertzog
5,040,716 A 8/1991 Stetz
D328,199 S 7/1992 Matsch
D328,940 S 8/1992 Matsch
D330,741 S 11/1992 Matsch
D330,742 S 11/1992 Matsch
D330,744 S 11/1992 Matsch
5,230,581 A 7/1993 Deng
5,269,533 A 12/1993 Kellams
5,299,839 A 4/1994 Mogavero
5,364,313 A 11/1994 Nickelson
5,390,913 A 2/1995 Kepler
5,399,132 A 3/1995 Bailey
5,469,678 A 11/1995 Zamerovsky
5,545,110 A 8/1996 Hsiang
5,549,067 A 8/1996 Jolin
5,575,738 A 11/1996 Millington et al.
D376,405 S 12/1996 Strawcutter et al.
5,590,974 A 1/1997 Yang
5,617,697 A 4/1997 Erwin
D382,618 S 8/1997 Gift
5,664,769 A 9/1997 Sadinsky et al.
5,674,157 A 10/1997 Wilkinson
5,711,743 A 1/1998 Nichols, Jr. et al.
5,810,695 A 9/1998 Sass
5,833,557 A 11/1998 Cole
5,876,311 A 3/1999 Coates et al.
5,921,049 A 7/1999 Sugiyama
5,941,798 A * 8/1999 Coan et al. ..... 482/27
6,001,045 A 12/1999 Gift et al.
6,017,292 A 1/2000 Gift et al.
6,032,431 A 3/2000 Sugiyama
6,053,845 A * 4/2000 Publicover et al. ..... 482/35
6,110,074 A 8/2000 Tacquet
6,135,921 A 10/2000 Holland et al.
6,162,061 A 12/2000 Taylor
6,193,632 B1 2/2001 Steger
6,216,717 B1 4/2001 Chen
6,261,207 B1 * 7/2001 Publicover et al. ..... 482/27
6,319,174 B1 11/2001 Alexander
6,402,414 B1 6/2002 Kanodia et al.
6,402,662 B1 6/2002 Rieber
6,413,004 B1 7/2002 Lin
6,450,187 B1 9/2002 Lin et al.
6,478,039 B2 11/2002 Suh
6,607,468 B1 8/2003 Nichols, Jr. et al.
6,742,202 B2 6/2004 Jones
6,748,962 B2 6/2004 Miller
6,802,169 B2 10/2004 Simmons
6,846,271 B2 1/2005 Publicover
7,182,713 B2 2/2007 Wang et al.
7,241,072 B2 7/2007 Patrignani
2002/0137598 A1 9/2002 Publicover et al.
2003/0026645 A1 2/2003 Hoke, Jr.
2003/0036460 A1 2/2003 Publicover
2003/0104905 A1 6/2003 Publicover
2004/0091307 A1 5/2004 James
2004/0121883 A1 6/2004 Publicover
2004/0147370 A1 7/2004 Wang et al.
2004/0171461 A1 9/2004 Alexander
2004/0171462 A1 9/2004 Alexander
2004/0176214 A1 9/2004 Yueh
2005/0032609 A1 2/2005 Nissen et al.
2005/0037896 A1 2/2005 Publicover
2005/0084627 A1 4/2005 Alexander
2005/0226683 A1 10/2005 Herb

OTHER PUBLICATIONS

L.H. Teh et al., "Strength of Weided T-Joint Truss Connections Between Equal Width Cold-Formed RHS," Research Report No. R831; Dept. of Civil Engineering, Centre for Advanced Structural Engineering, The University of Sydney, Aug. 2003.
Office action dated Oct. 15, 2009, U.S. Appl. No. 10/905,105, filed Dec. 15, 2004.
Final Office action dated Jun. 15, 2010, U.S. Appl. No. 10/905,105, filed Dec. 15, 2004.

* cited by examiner

VIEW A

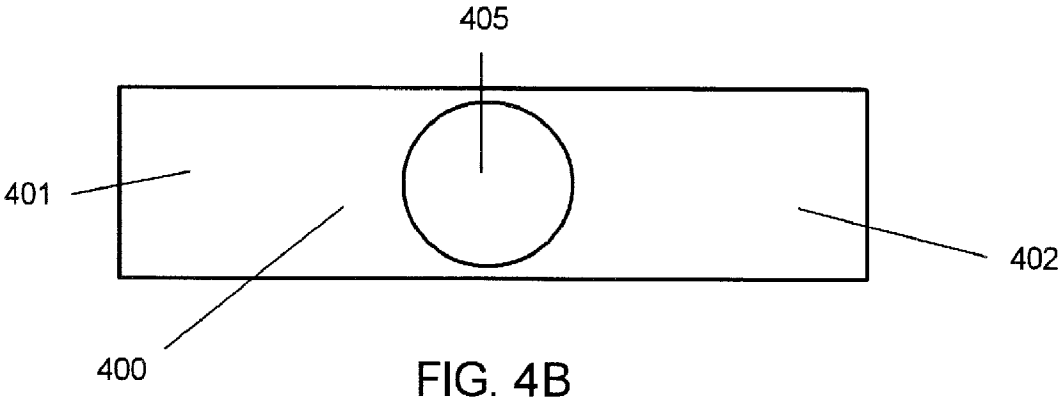
FIG. 4B
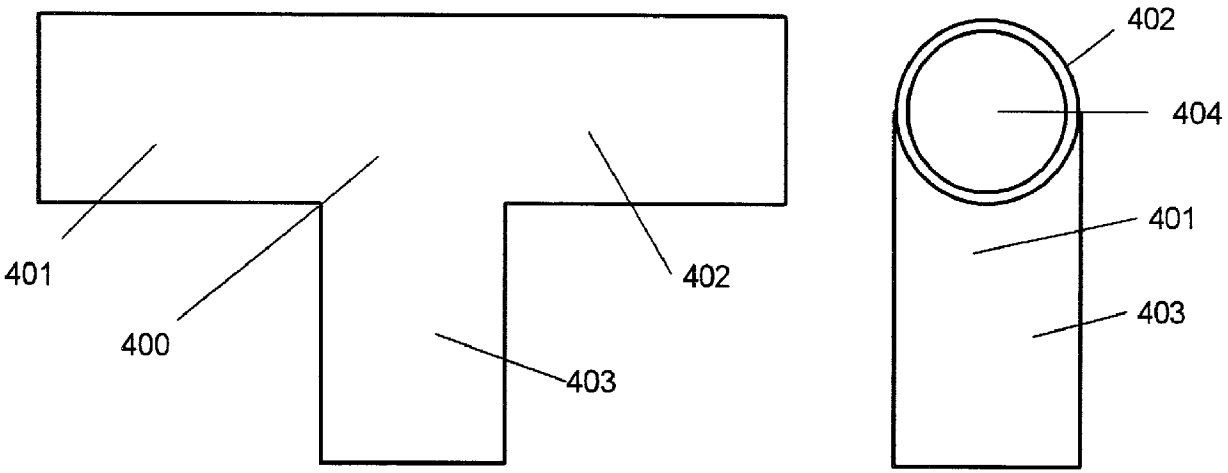
FIG. 4C
FIG. 4A

RECREATIONAL STRUCTURE USING A COUPLING MEMBER

CROSS-REFERENCE TO RELATED APPLICATION

The present patent application is a continuation-in-part patent application of U.S. patent application Ser. No. 10/908,469, filed May 12, 2005, entitled "Recreational Structure Using a Sleeve Joint Coupling," invented by Craig Adams, which is a continuation-in-part (CIP) patent application of U.S. patent application Ser. No. 10/905,105, filed Dec. 15, 2004, entitled "Recreational Structure Using A Sleeve-Joint Coupling," invented by Craig Adams, both of which are incorporated by reference herein.

BACKGROUND

The subject matter disclosed herein relates to recreational structures. More particularly, the subject matter disclosed herein relates to a frame arrangement for a recreational structure, such as a trampoline, that uses a coupling member.

DESCRIPTION OF THE RELATED ART

Recreational structures having frames, such as trampolines, are well-known. For example, a trampoline has a horizontal frame to which a rebounding surface is attached and a plurality of vertical frame members, or legs, that support the horizontal frame and rebounding surface above the ground. While the horizontal and vertical frame portions of a trampoline could be fabricated to be one unitary structure, such a unitary structure is cumbersome when the trampoline frame is transported to a place where the trampoline is used. Accordingly, trampoline frames are typically formed from a plurality of pieces that are fastened together at the time a trampoline is assembled.

A desirable characteristic for all trampoline frames formed from a plurality of pieces is that the various pieces are attached or joined to each other using a technique that is simple, quick to assemble and is reliable.

BRIEF SUMMARY

The subject matter disclosed herein provides a technique for joining structural components of a recreational structure, such as a trampoline, that is simple, quick to assemble and is reliable.

The subject matter disclosed herein provides a recreational structure frame system that includes a plurality of horizontal frame members, at least one vertical frame member, at least one vertical pole member, and at least one sleeve-joint coupling. Each horizontal frame member has two ends. Similarly, each vertical frame member has two ends, and each vertical pole member has two ends. In one exemplary embodiment, at least one coupling member has first, second and third arm members arranged to substantially form a T configuration. The first arm member and the second arm member are disposed in an opposite relationship with each other. The third arm member includes flange members that receive one end of a vertical frame member and one end of a vertical pole member. The second and third arm members each receive one end of a horizontal frame member.

The vertical pole member can be part of, for example, a safety enclosure, in which case the safety enclosure can include a plurality of vertical pole members, such that each vertical pole member is received by the flange members of the coupling member. A plurality of horizontal support members can be coupled to two adjacent vertical pole members, thereby forming the safety enclosure. In one exemplary embodiment, the vertical pole member is configured to substantially form an arch.

BRIEF DESCRIPTION OF THE DRAWINGS

The subject mater disclosed herein is illustrated by way of example and not by limitation in the accompanying figures in which like reference numerals indicate similar elements and in which:

FIGS. 4A-4C respectively show a side view, a top view and an end view of a second exemplary embodiment of a sleeve-joint coupling for a trampoline frame according to the subject matter disclosed herein;

DETAILED DESCRIPTION

It should be understood that the word "exemplary" is used herein to mean "serving as an example, instance, or illustration." Any embodiment described herein as "exemplary" is not necessarily to be construed as preferred or advantageous over other embodiments.

Figure 1:
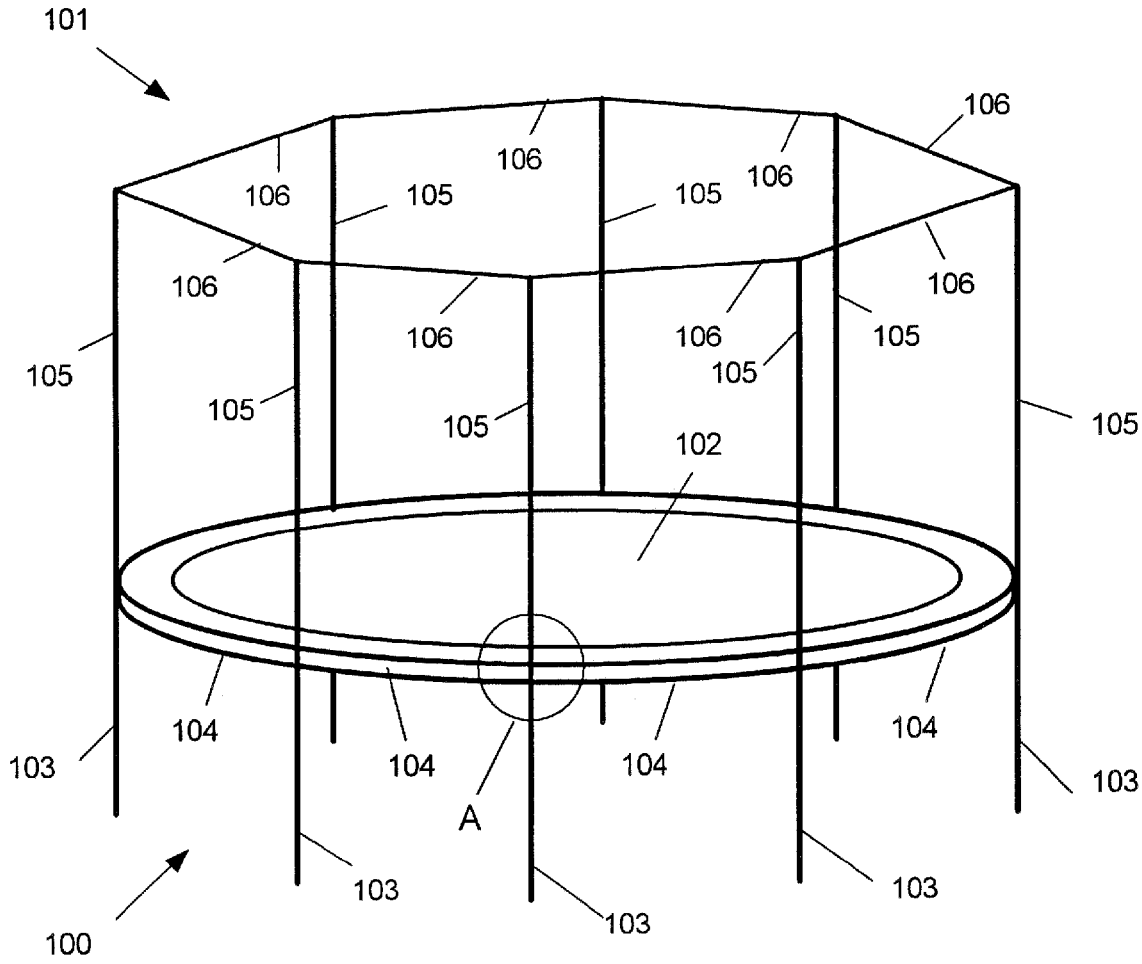
FIG. 1 depicts a perspective view of an exemplary trampoline having an exemplary safety enclosure.

FIG. 1 depicts a perspective view of an exemplary trampoline 100 having an exemplary safety enclosure 101. Trampoline 100 includes a rebounding surface 102 and a frame structure having vertical frame members 103 and a circular frame that can be formed from a plurality of circular frame members 104. Vertical frame members 103 and circular frame members 104 are typically made from hollow metal tubing having sufficient strength to bear the stresses and loads that are associated with trampolines. Safety enclosure 101 includes a frame structure having vertical pole members 105 and horizontal support members 106. A horizontal support member 106 is connected between adjacent vertical pole members in a substantially inflexible manner. A structural member that is suitable for both vertical pole members 105 and horizontal support members 106 is disclosed by U.S. Pat. No. 6,450,187 B1 to Lin et al., which is incorporated by reference herein.

Complete details of trampoline 100 and safety enclosure 101 are not shown in FIG. 1 for simplicity. For example, safety enclosure includes a mesh- or netting-type of material that extends between adjacent vertical pole members 105 and between horizontal frame members 106 and circular frame member 104 that together with circular frame 104, vertical pole members 105 and horizontal support members 106 operate as a fence around rebounding surface 102 in order to keep a user on trampoline 100 and reduce the risk of injury to the user.

Figure 2C:
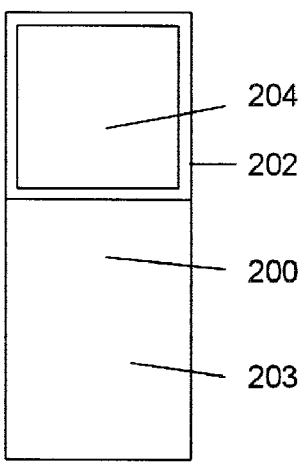
FIGS. 2A-2C respectively show a side view, a top view and an end view of the first exemplary embodiment of a sleeve joint coupling for a trampoline frame according to the subject matter disclosed herein.
Figure 2B:
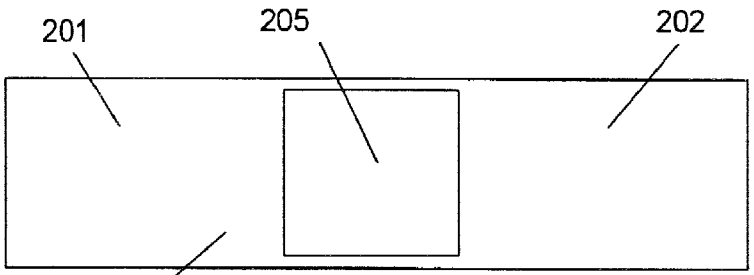
Figure 2A:
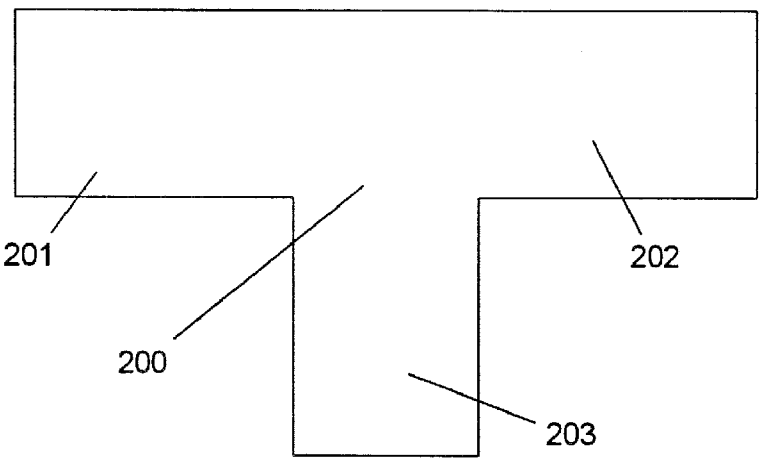
Figure 2D:
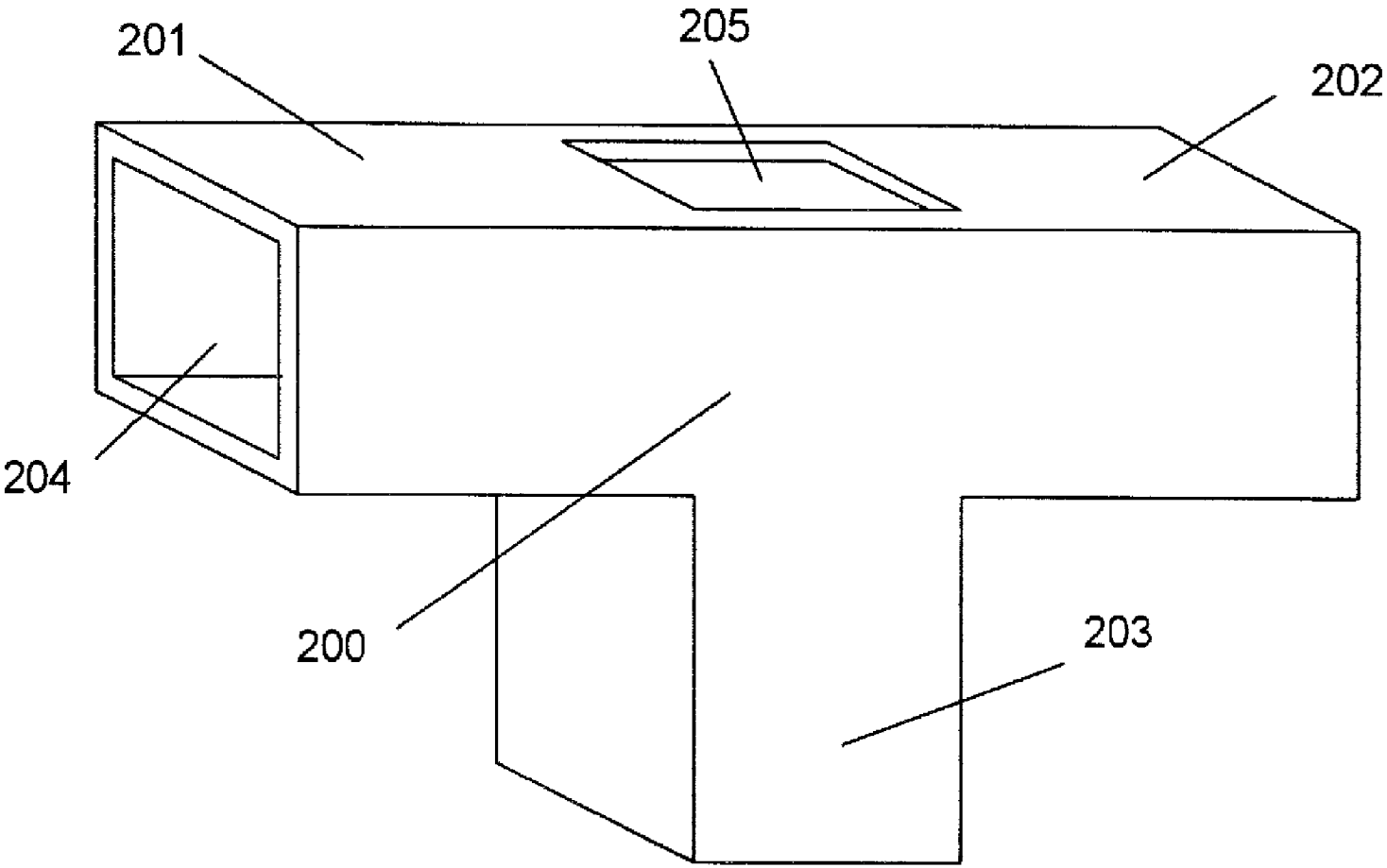
FIG. 2D shows a perspective view of the first exemplary embodiment of a sleeve joint coupling according to the present invention.

According to the subject matter disclosed herein, vertical pole members 105 of safety enclosure 101 attach to the frame structure of trampoline 100 using a plurality of sleeve-joint couplings, of which one is indicated at A in FIG. 1. FIGS. 2A-2D and FIG. 3 show details of a first exemplary embodiment of a sleeve-joint coupling according to the subject matter disclosed herein. In particular, FIGS. 2A-2C respectively show a side view, a top view and an end view of the first exemplary embodiment of a sleeve-joint coupling 200 for a trampoline frame according to the subject matter disclosed herein. FIG. 2D shows a perspective view of sleeve-joint coupling 200. Sleeve joint coupling 200 is generally shaped as a "T" and includes three arm members 201-203, each having a generally square cross-sectional shape. Each arm member 201-203 receives a trampoline frame member (not shown in FIGS. 2A-2C) of similar cross-sectional shape into an opening 204 (FIGS. 2C and 2D). Sleeve joint coupling 200 includes an opening 205, shown in FIG. 2B, that receives a safety enclosure vertical pole member (not shown in FIGS. 2A-2C) having a generally square cross-sectional member.

Figure 3:
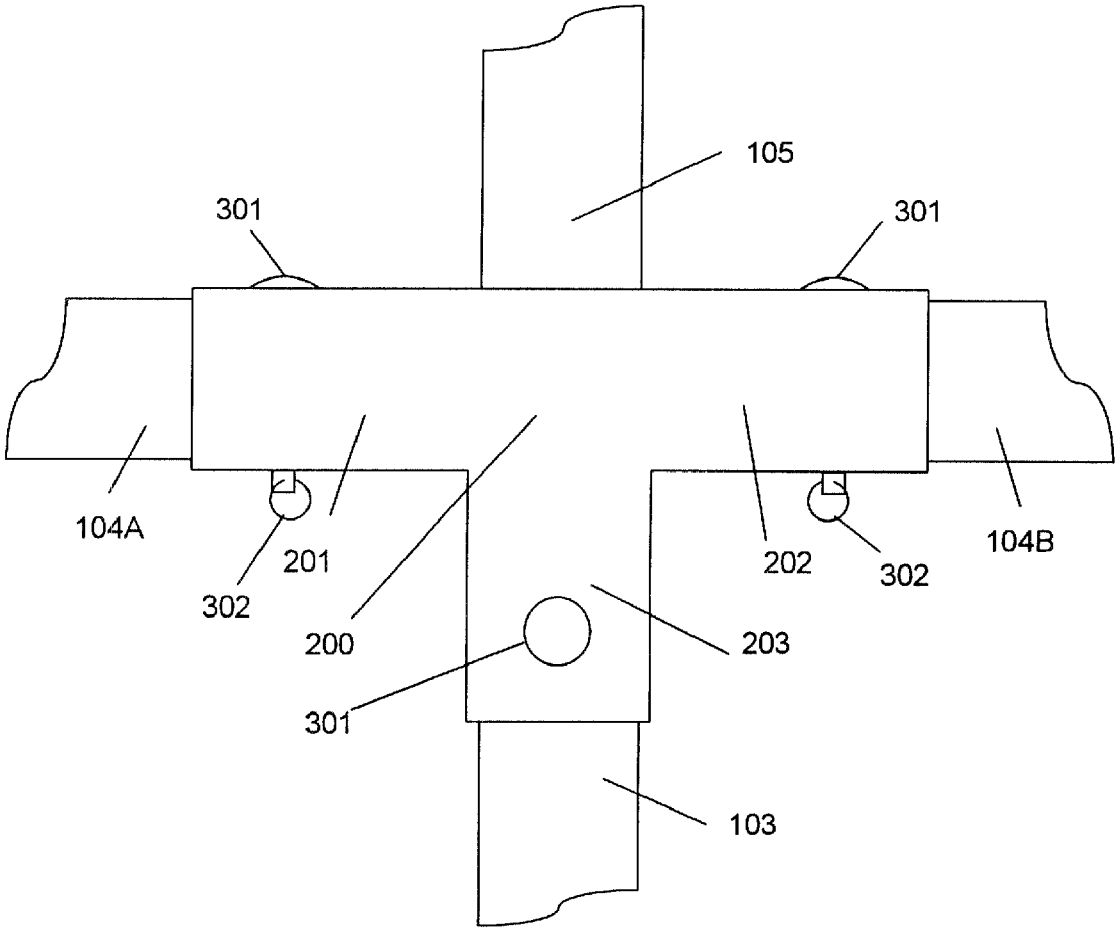
FIG. 3 shows details of a first exemplary embodiment of sleeve-joint coupling according to the subject matter disclosed herein.

FIG. 3 depicts View A, shown in FIG. 1, in greater detail. In FIG. 3, sleeve-joint coupling 200 couples circular frame member 104A to circular frame member 104B and to vertical frame member 103. Circular frame members 104A and 104B are secured to sleeve-joint coupling 200 using, for example, pins 301 and cotter rings 302 (not shown in FIGS. 2A-2D). Alternatively, circular frame members 104A and 104B can be secured to sleeve-joint coupling 200 using sheet metal screws, and/or bolts and nuts. As yet another alternative, the inner surface of each arm member of sleeve-joint coupling can be threaded to engage complementary threading on each end of a circular frame member 104 and on one end of a vertical frame member 103. Additionally, a threaded connection between sleeve-joint coupling 200 and a frame member can be secured using a pin and cotter ring arrangement, a sheet metal screw and/or a bolt and nut.

Vertical pole member 105 of safety enclosure 101 is inserted into opening 205 (FIGS. 3B and 3D) and extends through sleeve-joint coupling 200 into vertical frame member 103 a distance that is sufficient to distribute any shearing and/or torquing forces that may be imparted to vertical pole member 105 along the inside of vertical frame member 103 so that vertical frame member 103 does not fail. Vertical pole member 105 can be secured in vertical frame member 103 using, for example, a pin 301 and a cotter ring (not shown). Alternatively, vertical pole member 105 is secured in vertical frame member 103 using a sheet metal screw and/or a bolt and nut.

FIGS. 4A-4C respectively show a side view, a top view and an end view of a second exemplary embodiment of a sleeve-joint coupling 400 for a trampoline frame according to the subject matter disclosed herein. Sleeve-joint coupling 400 is generally shaped as a "T" and includes three arm members 401-403, each having a generally round cross-sectional shape. Each arm member 401-403 receives a trampoline frame member (not shown in FIGS. 4A-4C) of similar cross-sectional shape into an opening 404 (FIG. 4C). Sleeve-joint coupling 400 includes an opening 405, shown in FIG. 4B, that receives a safety enclosure vertical pole member (not shown in FIGS. 4A-4C) having a generally round cross-sectional member.

Figure 5B:
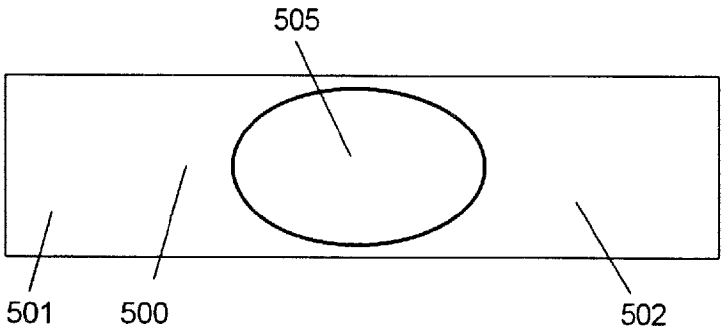
FIGS. 5A-5C respectively show a side view, a top view and an end view of a third exemplary embodiment of a sleeve-joint coupling for a trampoline frame according to the subject matter disclosed herein.
Figure 5A:
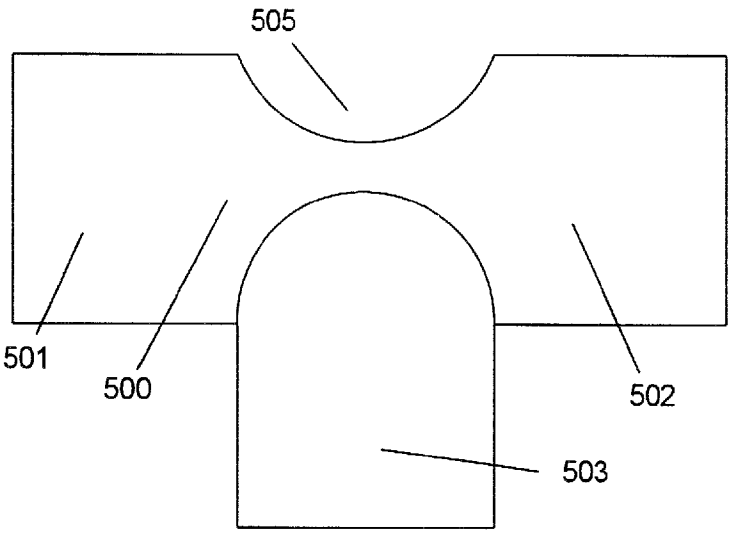
Figure 5C:
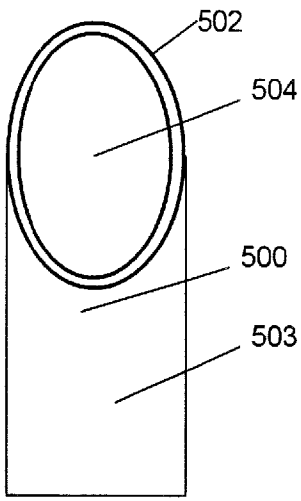

FIGS. 5A-5C respectively show a side view, a top view and an end view of a third exemplary embodiment of a sleeve-joint coupling 500 for a trampoline frame according to the subject matter disclosed herein. Sleeve-joint coupling 500 is generally shaped as a "T" and includes three arm members 501-503, each having a generally oval cross-sectional shape. Each arm member 501-503 receives a trampoline frame member (not shown in FIGS. 5A-5C) of similar cross-sectional shape into an opening 504 (FIG. 5C). Sleeve-joint coupling 500 includes an opening 505, shown in FIG. 5B, that receives a safety enclosure vertical pole member (not shown in FIGS. 5A-5C) having a generally oval cross-sectional member.

Figure 6B:
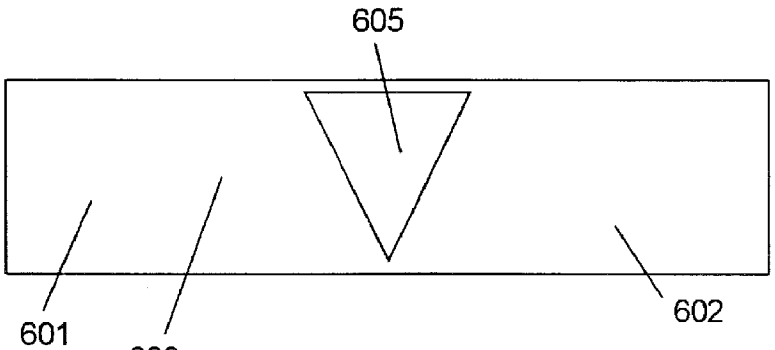
FIGS. 6A-6C respectively show a side view, a top view and an end view of a fourth exemplary embodiment of a sleeve-joint coupling for a trampoline frame according to the subject matter disclosed herein.
Figure 6A:
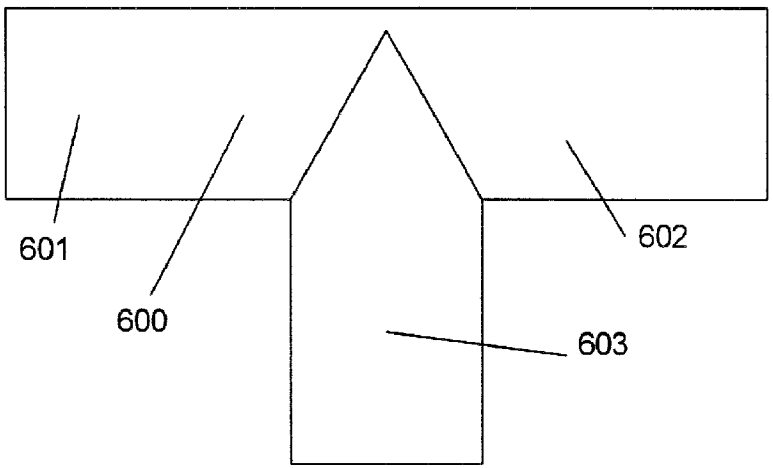
Figure 6C:
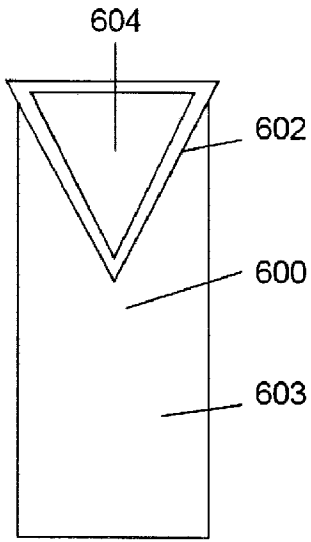

FIGS. 6A-6C respectively show a side view, a top view and an end view of a fourth exemplary embodiment of a sleeve-joint coupling 600 for a trampoline frame according to the subject matter disclosed herein. Sleeve-joint coupling 600 is generally shaped as a "T" and includes three arm members 601-603, each having a generally triangular cross-sectional shape. Each arm member 601-603 receives a trampoline frame member (not shown in FIGS. 6A-6C) of similar cross-sectional shape into an opening 604 (FIG. 6C). Sleeve-joint coupling 600 includes an opening 605, shown in FIG. 6B, that receives a safety enclosure vertical pole member (not shown in FIGS. 6A-6C) having a generally triangular cross-sectional member.

Figure 7B:
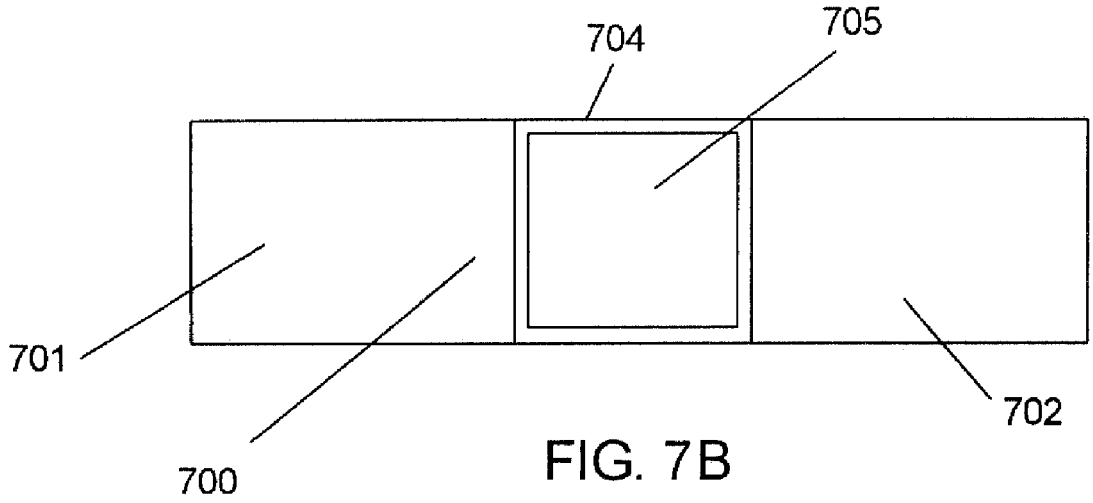
FIGS. 7A and 7B respectively show a side view and a top view of a fifth exemplary embodiment of a sleeve-joint coupling for a trampoline frame according to the subject matter disclosed herein.
Figure 7A:
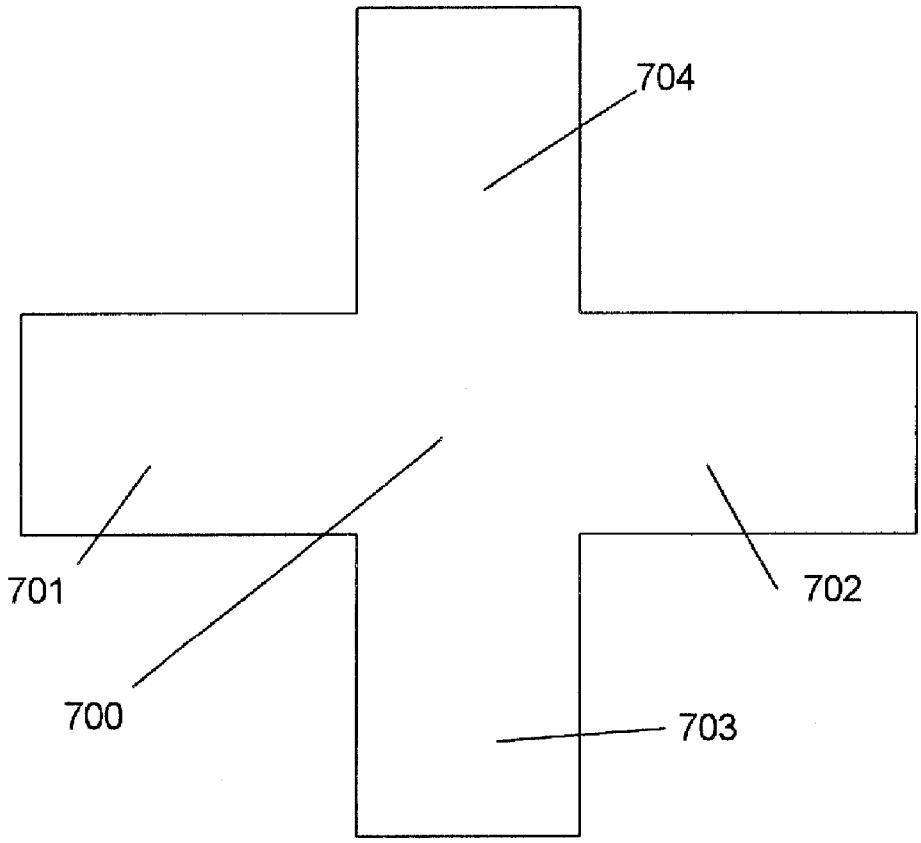

FIGS. 7A and 7B respectively show a side view and a top view of a fifth exemplary embodiment of a sleeve-joint coupling 700 for a trampoline frame according to the subject matter disclosed herein. Sleeve-joint coupling 700 is generally shaped as an "X" or a "+" and includes four arm members 701-704, each having a generally square cross-sectional shape. Each arm member 701-704 receives a trampoline frame member (not shown in FIGS. 7A and 7B) of similar cross-sectional shape into an opening 705, of which only one opening 705 is shown (FIG. 7B). Each opening 705 receives a safety enclosure vertical frame member 103, a circular frame member 104 or a vertical pole member 105 (none of which are shown in FIGS. 7A and 7B) having a generally square cross-sectional member. It should be understood that sleeve-joint coupling 700 can have an alternative cross-sectional shape, such as any of the exemplary cross-sectional shapes described herein, and a mating vertical frame member, circular frame member and vertical pole member would have a corresponding cross-sectional shape.

Figure 8B:
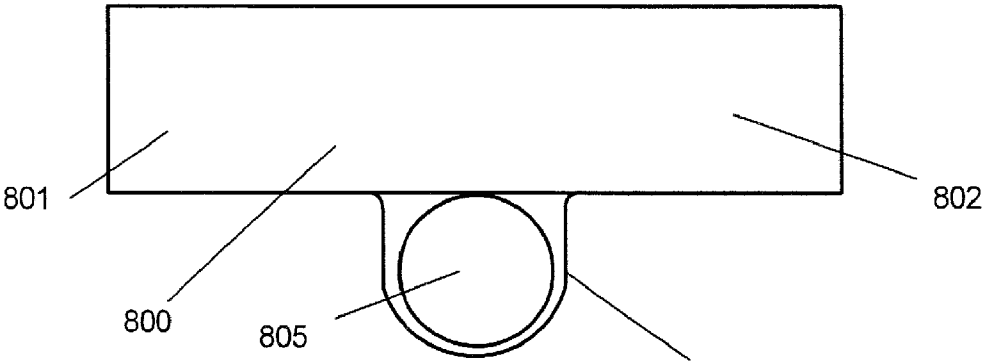
FIGS. 8A-8C respectively show a side view, a top view and an end view of a sixth exemplary embodiment of a sleeve-joint coupling for a trampoline frame according to the subject matter disclosed herein.
Figure 8A:
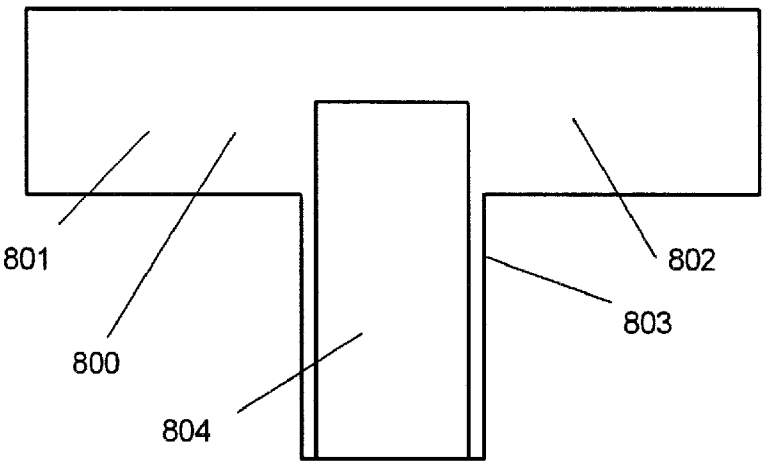
Figure 8C:
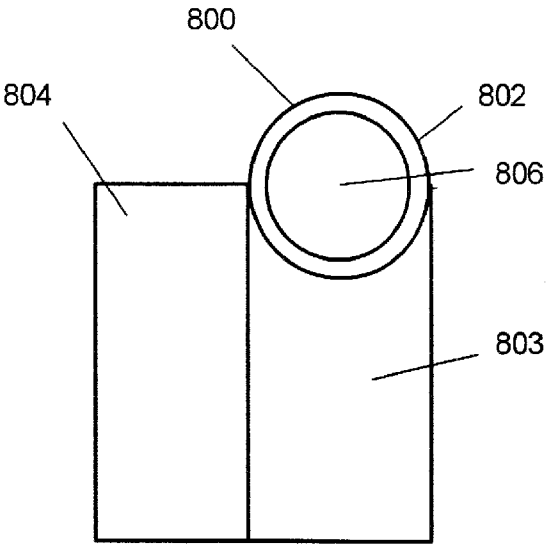

FIGS. 8A-8C respectively show a side view, a top view and an end view of a sixth exemplary embodiment of a sleeve-joint coupling 800 for a trampoline frame according to the subject matter disclosed herein. Sleeve-joint coupling 800 is generally shaped as a "T" and includes three arm members 801-803, each having a generally round cross-sectional shape. Sleeve-joint coupling 800 also includes a side sleeve member 804 having an aperture 805, configured as a blind hole, that receives a safety enclosure vertical pole member (not shown in FIGS. 8A-8C) having a generally round cross-sectional member. Side sleeve member 804 has sufficient length and strength to allow a safety enclosure vertical pole to extend into side sleeve member 804 so that the vertical pole would not come out during use. Each arm member 801-803 receives a trampoline frame member (also not shown in FIGS. 8A-8C) of similar cross-sectional shape into an opening 806 (FIG. 8C). In an alternative embodiment, aperture 805 could be configured to allow a safety enclosure vertical pole to extend through the length of the side sleeve member 804 to the ground or to another device that fastens the vertical pole to the corresponding vertical frame member 103.

Figure 9C:
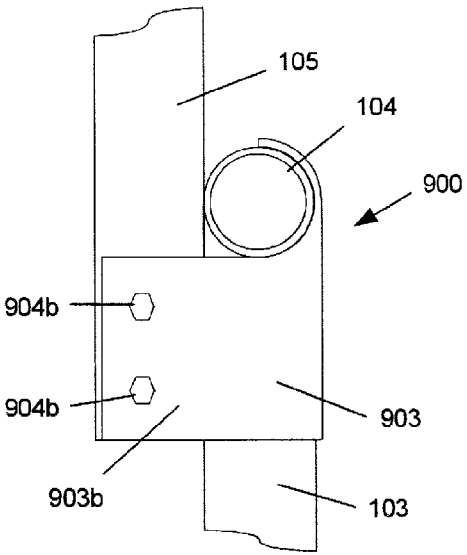
FIG. 9 depicts a top cutaway view of the first exemplary embodiment of a sleeve joint coupling according to the present invention.
Figure 9B:
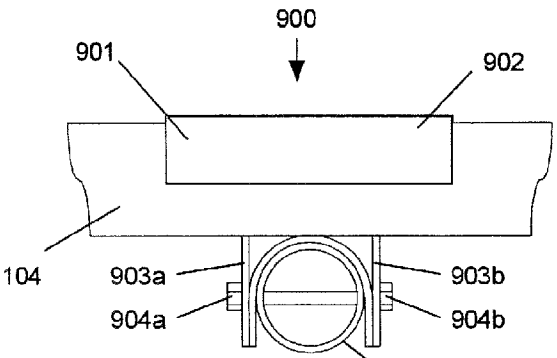
Figure 9A:
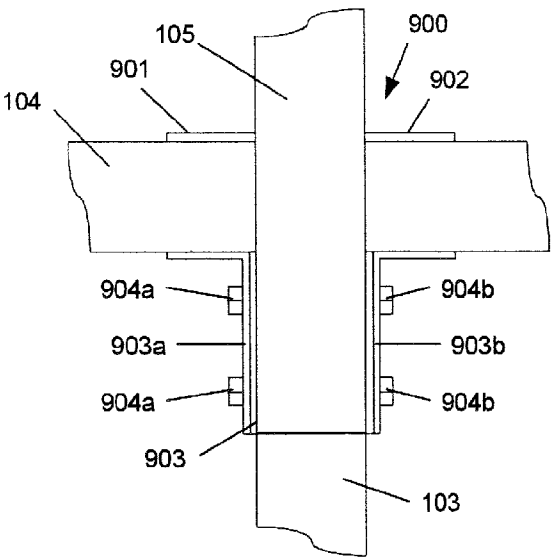

FIGS. 9A-9C respectively show side, top and end views of an exemplary embodiment of a coupling member 900 for a trampoline frame according to the subject matter disclosed herein. Coupling member 900 is generally shaped as a "T" and includes three arm members 901-903, each having a cross-sectional shape having a portion that is generally round. Each arm member 901 and 902 receives a corresponding circular frame member 104. Arm member 903 receives a corresponding vertical frame member 103. Alternatively, each arm member 901-903 has a cross-sectional shape that matches the cross-sectional shape of the corresponding circular frame member and vertical frame member. Arm 903 of coupling member 900 is also configured with flange members 903*a* and 903*b* that receive a vertical pole member 105 of a safety enclosure. Vertical pole member 105 is held in place between flange members 903*a* and 903*b* with fasteners 904*a* and 904*b*, such as a bolt 904*a* and nut 904*b*, that extend through holes (not shown) in vertical pole member 105. Flange members 903*a* and 903*b* have sufficient length and strength, and fasteners 904*a* and 904*b* have sufficient strength so that vertical pole member 105 remains in place during use. In an alternative embodiment, vertical pole member 105 could extend past flange member 903*a* and 903*b* to the ground or to another device that fastens vertical pole member 105 to the corresponding vertical frame member 103.

Figure 10:
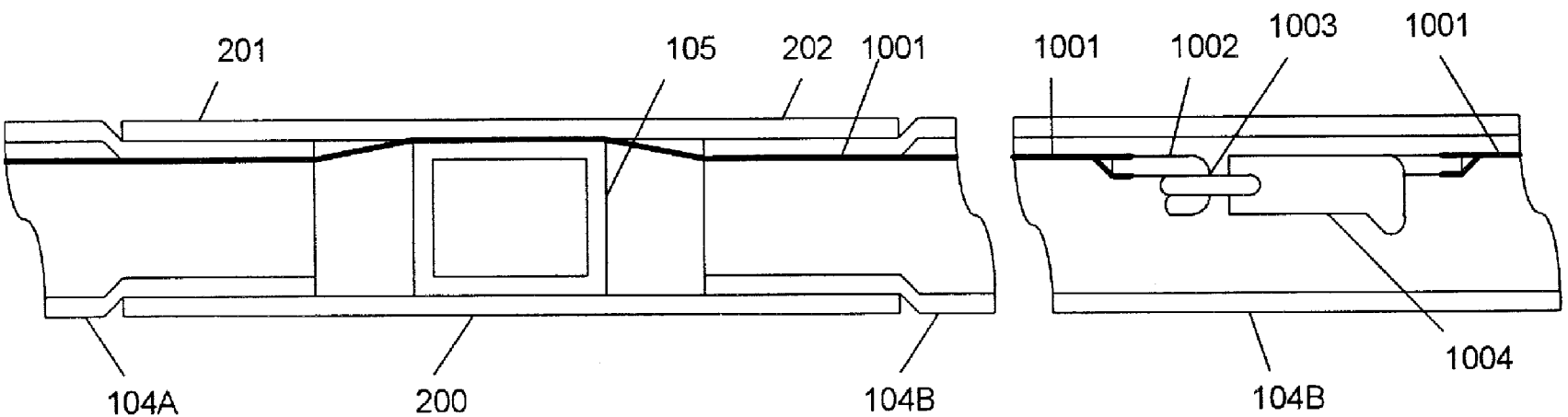
FIG. 10 shows a cut-away view of an exemplary embodiment of a vertical pole member for a safety enclosure, a sleeve-joint coupling, and a vertical frame member according to the present invention.

FIG. 10 depicts a top cutaway view of the first exemplary embodiment of a sleeve-joint coupling 200 according to the subject matter disclosed herein. Two circular frame members 104A and 104B are shown in FIG. 10 respectively engaging arm members 201 and 202 of sleeve-joint coupling 200. A vertical pole member 105 of a safety enclosure is also shown. A frame tension member 1001, such as a strap of webbing, a wire or a cable, is shown threaded through circular frame members 104A and 104B and sleeve-joint coupling 200, in addition the other circular frame members and sleeve-joint coupling forming a trampoline frame. Frame tension member 1001 is fastened in a well-known manner to a hook assembly 1002 that engages a loop 1003 of a buckle assembly 1004 that is accessible through a hole (not shown) in circular frame member 104B. Buckle assembly 1004 has two positions; an open position that allows hook assembly 1002 and loop 1003 to be conveniently engaged, and a closed assembly that places frame tension member 1001 under tension. When frame tension member 1001 is under tension, each sleeve-joint coupling 200 that frame tension member 1001 passes through is urged toward the center of the trampoline frame structure, thereby making the joints of frame structure even more reliable. Alternatively, a plurality of frame tension members can be used to form a line of continuous tension around a trampoline frame instead of a single frame tension member, as depicted in FIG. 10. As yet another alternative, frame tension member 1001 could be attached to the outside of sleeve-joint coupling 200, such as through a loop fastened to the outside of sleeve-joint coupling 200. Still another alternative provides that a turn-buckle arrangement is used for placing tension on frame tension member 1001.

While exemplary trampoline 100 shown in FIG. 1 is depicted as being round, it should be understood that the subject matter disclosed herein could be used with a trampoline and safety enclosure having a different shape, such as square, rectangular or oval. Additionally, the sleeve-joint coupling of the subject matter disclosed herein can be made from any suitable material that has sufficient strength to bear the loads and stresses that are associated with trampolines, such as metals and plastics. Further, while the sleeve-joint coupling of the subject matter disclosed herein has been described in terms of vertical frame members and circular frame members fitting into the sleeve-joint coupling, it should be understood that the sleeve-joint coupling of the subject matter disclosed herein can be configured so that one or all of the arm members of the sleeve-joint coupling fit into vertical frame members and circular frame members of the trampoline frame. Further still, while the sleeve-joint coupling of the subject matter disclosed herein has been described as having several exemplary cross-sectional shapes, it should be understood that a sleeve-joint coupling according to the subject matter disclosed herein could have any cross-sectional shape or have arm members having different cross-sectional shapes. As yet another alternative, the sleeve-joint coupling of the subject matter disclosed herein could be formed to be part of a vertical frame member. As still another alternative, the sleeve-joint coupling of the subject matter disclosed herein could be configured to substantially form a "T".

While the vertical pole members 105 of safety enclosure 101 has been described as extending into vertical frame members 103, it should be understood that at least one or more vertical pole member 105 of safety enclosure 101 could extend to the ground along the outside of a vertical frame member 103, in which case such a vertical pole member would be attached to the corresponding vertical frame member at a minimum of two places, such as by using a sleeve-joint coupling similar to that shown in FIGS. 8A-8C and, for example, a tie-wrap device near the bottom of a vertical frame member 103.

Figure 11:
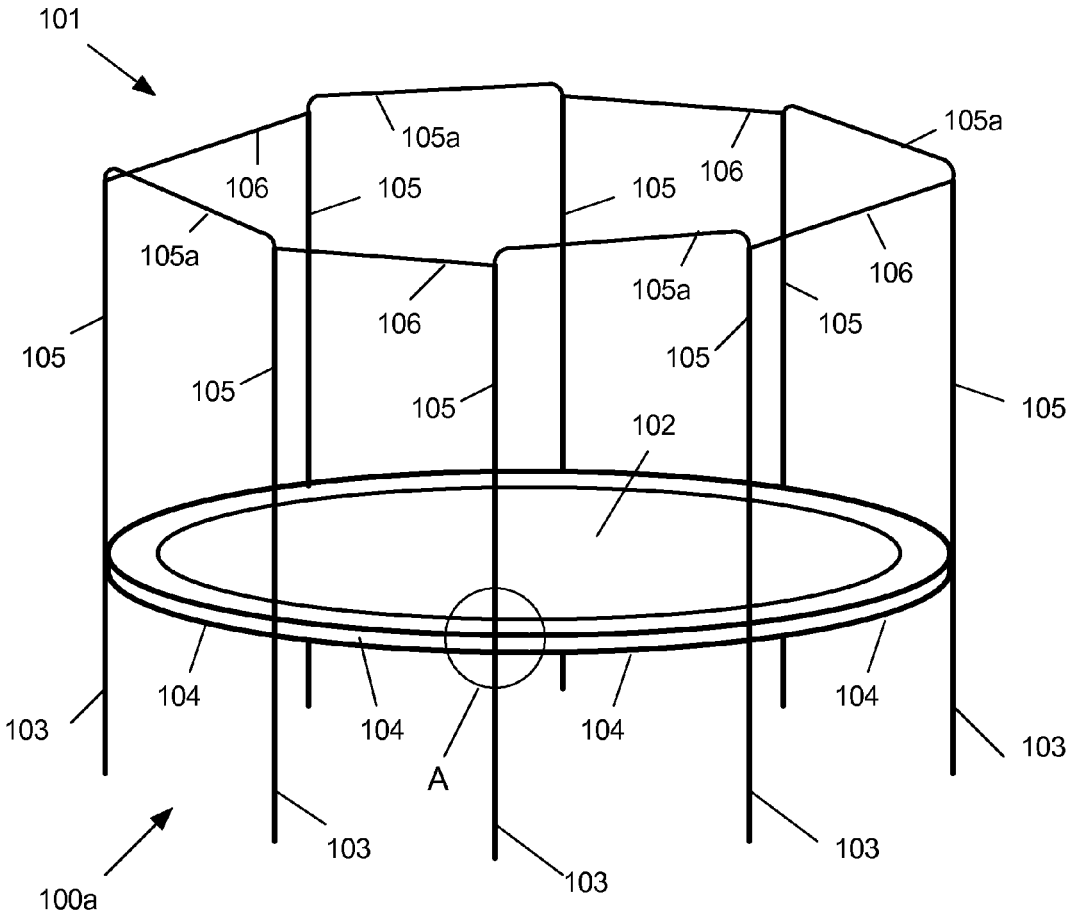
FIG. 11 depicts a perspective view of an exemplary trampoline having an exemplary alternative embodiment of a safety enclosure.

As yet another alternative embodiment, a safety enclosure vertical pole member 105 could be configured to form an arch (105*a* of trampoline 100*a* in FIG. 11), or an arc shape, between two frame members 103. The two frame members 103 could be adjacent or could be separated by one or more other frame members 103. A horizontal support member would then be connected between adjacent peaks of an arch in a substantially inflexible manner.

Although the foregoing subject matter has been described in some detail for purposes of clarity of understanding, it will be apparent that certain changes and modifications may be practiced that are within the scope of the appended claims. Accordingly, the present embodiments are to be considered as exemplary and not restrictive, and the subject matter disclosed herein is not to be limited to the details given herein, but may be modified within the scope and equivalents of the appended claims.

What is claimed is:

1. A coupling assembly for a trampoline assembly with a first horizontal frame member, a second horizontal frame member, a vertical frame member, and a vertical pole member, the first and second horizontal frame members being arranged substantially along a horizontal frame axis, the coupling assembly comprising:

a coupling device that includes:

a first arm member comprising first and second ends, the first and second ends being arranged substantially along a first longitudinal axis, the first end including a first opening capable of receiving an end of the first horizontal frame member and the second end including a second opening capable of receiving an end of the second horizontal frame member, a second arm member capable of receiving the vertical frame member, the second arm member projecting substantially along a second longitudinal axis and in only one direction from the first longitudinal axis, and a side-sleeve member capable of receiving the vertical pole member, the side-sleeve member projecting substantially along a third longitudinal axis, the third longitudinal axis being different from the second longitudinal axis; and a tension member operable to couple to both the first and second horizontal frame members and that is operable to apply a force between the first and second horizontal frame members to compress the first and second horizontal frame members toward each other.

2. The coupling assembly according to claim 1, wherein the second arm member comprises a cross-sectional shape that substantially corresponds to a cross-sectional shape of the vertical frame member.

3. The coupling assembly according to claim 1, wherein the first and second arm members are arranged to substantially form a "T" configuration.

4. The coupling assembly according to claim 1, wherein the trampoline assembly includes a safety enclosure that is at least partially supported by the side-sleeve member.

5. The coupling assembly according to claim 4, wherein the vertical pole member comprises at least a part of the safety enclosure, and wherein the vertical pole member is received by the side-sleeve member to be supported upright by the side-sleeve member.

6. The coupling assembly according to claim 5, wherein the side-sleeve member projects along the third longitudinal axis and in only one direction from the first longitudinal axis.

7. The coupling assembly according to claim 1, wherein the third longitudinal axis is substantially parallel to the second longitudinal axis.

8. The coupling assembly of claim 1, wherein the tension member extends internally through the first horizontal frame member, the second horizontal frame member, and through the coupling device.

9. The coupling assembly of claim 1, wherein the tension member is operably secured to the first horizontal frame member and the second horizontal frame member and that is disposed internally to at least one of the first horizontal frame member and the second horizontal frame member.

10. The coupling assembly of claim 1, wherein the first arm member of the coupling device terminates at a top surface that lies within an imaginary top plane, wherein the second arm member terminates at a bottom surface that lies within an imaginary bottom plane, and wherein the side-sleeve member includes a top rim that is disposed between the imaginary top and bottom planes.

* * * * *